US005343725A

United States Patent [19]

Sabine

[11] Patent Number: 5,343,725

[45] Date of Patent: Sep. 6, 1994

[54] TUBE BENDING APPARATUS AND METHOD

[75] Inventor: James R. Sabine, Burlington, Canada

[73] Assignee: Eagle Precision Technologies Inc., Brantford, Canada

[21] Appl. No.: 86,866

[22] Filed: Jul. 7, 1993

[51] Int. Cl.[5] ..... B21D 7/02

[52] U.S. Cl. ..... 72/155; 72/11; 72/22; 72/149; 72/369

[58] Field of Search ..... 72/8, 11, 22, 23, 149, 72/151, 155, 369, 21, 10

[56] References Cited

U.S. PATENT DOCUMENTS

| | | | |
|---|---|---|---|
| 2,810,422 | 10/1957 | Bower | 72/23 |
| 3,766,764 | 10/1973 | Ross et al. | 72/22 |
| 3,821,525 | 6/1974 | Eaton et al. | 72/8 |
| 4,126,030 | 11/1978 | Zollweg et al. . | |
| 4,970,885 | 11/1990 | Chipp et al. | 72/151 |
| 5,142,895 | 9/1992 | Schuchert . | |
| 5,259,224 | 11/1993 | Schwarze | 72/149 |

FOREIGN PATENT DOCUMENTS

| | | | |
|---|---|---|---|
| 227529 | 10/1987 | Japan | 72/151 |
| 76945 | 3/1993 | Japan | 72/155 |

*Primary Examiner*—David Jones

*Attorney, Agent, or Firm*—Smith, Lyons, Torrance, Stevenson & Mayer

[57] ABSTRACT

An improved tube rotary draw bending apparatus for bending a tube having a bend die around which a bend in the tube is formed, a pressure die and means for maintaining a pre-programmed frictional profile of the interaction of the tube with the pressure die during the bending operation. Improved quality of the bent tube is consistently obtained.

8 Claims, 12 Drawing Sheets

TUBE BENDING APPARATUS AND METHOD

FIELD OF THE INVENTION

This invention relates to apparatus and methods for the rotary draw bending of rigid tubes, such as those of use in automotive exhaust systems, heat exchangers and aircraft hydraulic systems.

BACKGROUND OF THE INVENTION

In prior apparatus used for the rotary draw bending of pipe and tube, such as of use in automobile exhaust systems, heat exchangers and aircraft construction, a primary component is the bending head of the apparatus. The bending head comprises a rotary bend die, an opposing clamp die which clamps a section of the tube immediately preceding the section of the tube where the bend is to be formed, and a pressure die located directly behind the clamped section of the tube. As the tube is pulled around the rotary bend die, the pressure die moves substantially in unison with the tube while resisting the radial reaction force of the tube acting on the pressure die. Thus, the pressure die and rotary bend die cause the tube to be squeezed therebetween during the bending operation.

Many variable factors, such as the type of tube material, tube wall thickness, shape of the tube section to be formed, the radius of the bend and the like, need to be considered when tube bending with rotary draw bending machinery is carried out. However, although commercially acceptable tubes are manufactured with apparatus hereinbefore described, there is a need for pipe bending methods and apparatus which are capable of producing tubes of a consistent, desired quality. While not being bound by theory, applicant believes that although the tube and pressure die move substantially in unison, slight changes in the values of the above variables in consequence of changes in pipe diameter, wall thickness, the presence of impurities and the like, during the bending operation may cause small, but significant changes in the speed of the pressure die relative to that of the tube. Thus, by exerting a negative boost or slowing force to the tube by means of applying a force to the pressure die, the forward motion of the tube is restrained. Alternatively, by exerting a positive boost or quickening force to the pressure die during the bending operation the frictional force enhances forward movement of the outer tube. Thus, by monitoring the speed of the pressure die and the perpendicular force exerted on the tube and compensating for the effects of changes in the above parameters, an improved tube product can consistently be manufactured. Further, in addition by monitoring the force required to achieved the desired boost speed, tool wear and/or contamination on the tube material can be detected.

SUMMARY OF THE INVENTION

It is an object of the present invention to provide an apparatus for bending a tube consistently to an improved desired standard.

It is a further object of the invention to provide apparatus for bending tubes not requiring internal mandrel support with a higher 'bend factor' and to bend tubes to a tighter bend radius than is currently possible.

It is a yet further object to provide apparatus for bending tubes which minimizes marking of the tube caused by scraping of the tube by the apparatus.

It is a yet still further object of the present invention to provide a method of bending a tube to produce a bent tube of consistently high standards.

These and other objects of the invention will become apparent from a reading of this specification as a whole.

Accordingly, the present invention provides sophisticated measuring, programming and control features for the speed relationship between a pressure die and the circumferential speed of a bending form block, the boost force applied to the tube by the pressure die and the squeeze force applied to the tube by the reaction block system acting on the tube.

The system can operate in either or both of two modes as selected by an operator, depending on the application. These modes are the speed control mode, which gives priority to the speed relationship between the pressure die and the tube, and the force control mode which gives priority to the boost force applied to the tube.

In speed control mode an operator programs the differential speed between the pressure die and the circumferential speed of a bending form of a bend arm. The system allows the speed relationship to be varied during each bend based on the actual position of a bend arm to allow for the varying boost requirements during the bend. A "taper" feature is available, which allows the speed differential to be tapered to a preset value at the end of each bend regardless of the final bend angle to ensure consistent results at the end of each bend. A force feedback system is used to monitor the actual boost force applied to the tube, while achieving the desired speed profile, thereby allowing the system to detect changes in the interaction between the pressure die and the tube. The system will adjust the reaction force applied by the reaction block actuator of the pressure die system, within programmed limits to compensate for the frictional variations such that the boost force applied to the tube remains constant.

In force control mode the pressure die is controlled based on a programmed boost force profile. A further "taper" feature is also available which allows the boost force to be tapered to a preset value at the end of each bend regardless of the final bend angle to ensure consistent results at the end of each bend. This mode will use a force feedback system to provide closed loop control for the boost force to ensure precise, consistent results. A position feedback device is used to monitor the actual pressure die speed while applying the desired boost force, thereby allowing the system to detect changes in the interaction between the pressure die and the tube. The system will also adjust the reaction force applied by the reaction block within programmed limits to compensate for the frictional variations such that the boost force applied to the tube remains constant.

Accordingly, in one aspect the invention provides an improved rotary draw bending apparatus for bending a tube comprising a bend die around which a bend in said tube is formed and a pressure die to counter the reaction force of the tube during the bending operation; the improvement comprising means for maintaining a preprogrammed frictional profile of the interaction of said tube with said pressure die during the bending operation.

In a more preferred feature the invention provides an improved tube rotary draw bending apparatus comprising a bending form block around which a bend in said tube is formed; a pressure die in frictional contact with said tube to counter the reaction force of the tube during the bending operation; means to provide a boost pressure to said pressure die; means to provide a reaction force to said pressure die; a rotatable bend arm assembly in communication with said bending form block and which transmits bending torque to said tube and effects relative movement of said tube and said pressure die under a pre-programmed profile; said improvement comprising automatic sensing and control means for maintaining said pre-programmed frictional profile of the interaction of said tube with said pressure die during the bending operation.

In one aspect the sensing and control means comprises speed sensing means to determine a change in the speed of said pressure die relative to said tube while the boost pressure acting on the pressure die follows the pre-selected boost profile; reaction force change means to change said reaction force applied to said pressure die active on said tube in response to said change in said speed to maintain said friction profile; and automatic control means in communication with said speed sensing means and said reaction force change means.

The speed sensing means preferably comprises position sensor means for determining the change of longitudinal position of the pressure die relative to the tube and in communication with the automatic control means. The position sensor means preferably comprises a pressure die position sensor for determining the position of the pressure die and a bend arm position sensor for determining the position of the tube in communication with the pressure die position sensor, wherein the pressure die position sensor and the bend arm position sensor is in communication with the automatic control means. In an alternative aspect, the sensing and control means comprises boost force sensing means to determine a change in the boost force applied to the pressure die while the speed of the pressure die follows a preselected speed profile; reaction force change means to change the reaction force applied to the pressure die active on the tube in response to the change in the boost force to maintain the friction profile; and automatic control means in communication with the boost force sensing means and the reaction force change means to control the change in the speed profile.

In yet a further aspect the invention provides a process for rotary draw bending a tube comprising contacting said tube with a pressure die to provide frictional contact; subjecting said tube to a bending torque to bend said tube and effect movement of said tube; applying a longitudinal pressure boost to said pressure die at a speed according to a pre-programmed speed profile; applying a perpendicular reaction force to said pressure die to maintain said frictional contact; the improvement comprising providing a pre-programmed friction profile of said tube and said pressure die interaction; measuring any change in the speed of said pressure die relative to said tube; causing said boost pressure acting on said pressure die to following a pre-selected boost profile; and automatically changing said reaction force in response to said change in said relative speed of said pressure die to maintain said friction profile.

Thus, the present invention provides sophisticated programming and monitoring features for controlling the interaction between the pressure die and the tube during the bending operation. The system includes feedback devices to monitor the speed of the pressure die relative to the tube and the boost force applied to the tube by the pressure die actuator during each bend. The relationship between these two parameters is determined by the friction between the pressure die and the tube and can thus be altered by varying the squeeze force applied to the tube by the reaction block actuator. Using this principle, the system will continuously adjust the boost force and the squeeze force during each bend to maintain a predefined boost force profile and boost speed profile. Since these are dependant variables, the system operates in one of two modes as selected by the operator depending on the application. Speed control mode which gives priority to the speed relationship between the pressure die and the tube or force control mode which gives priority to the boost force applied to the tube by the pressure die actuator.

An operator must first enter the parameters governing the bending process. The desired bend angle along with the bend arm speed and acceleration is used to generate the bend speed profile. The operator also enters the maximum and minimum values for the reaction force applied to-the tube. The operator then selects either force control or speed control mode for the process. If force mode is selected, the operator enters the boost force profile data along with the maximum pressure die/tube speed differential. If speed mode is selected, the operator enters the pressure die speed profile data along with the maximum pressure die boost force to be applied to the tube. The system uses this data to generate the boost force and pressure die speed profile curves for the bend.

The computer used to control the process consists of a servo control board and a host computer system. The servo control board is a commercially available product which generates an analog command signal to the actuator being controlled and monitors a feedback signal (either position or force in this case) from the actuator. It should be noted that the board will determine the speed of the motion by the rate of change from the position feedback. The software on the board continuously adjusts the command signal at rates up to several thousand times per second to force the feedback signal to follow a programmed profile.

BRIEF DESCRIPTION OF THE DRAWINGS

In order that the invention may be better understood, a preferred embodiment will now be described, by way of example only, with reference to the accompanying drawings wherein.

DESCRIPTION OF A PREFERRED EMBODIMENT

Figure 1:
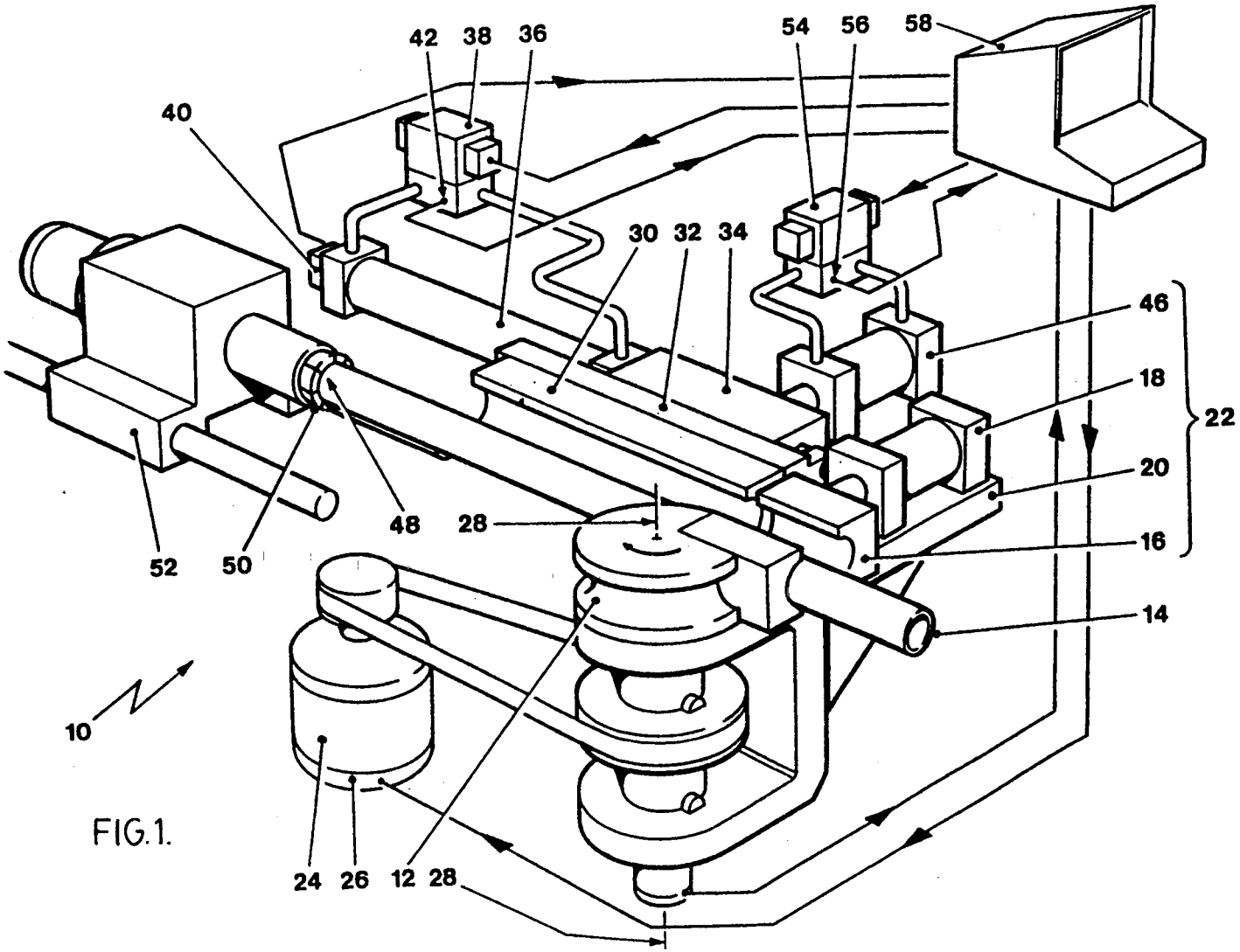
FIG. 1 is a diagrammatic, perspective view of a bending apparatus according to the invention, control means for use therewith and a tube located therein in a non-clamped, pre-bend position.
Figure 2:
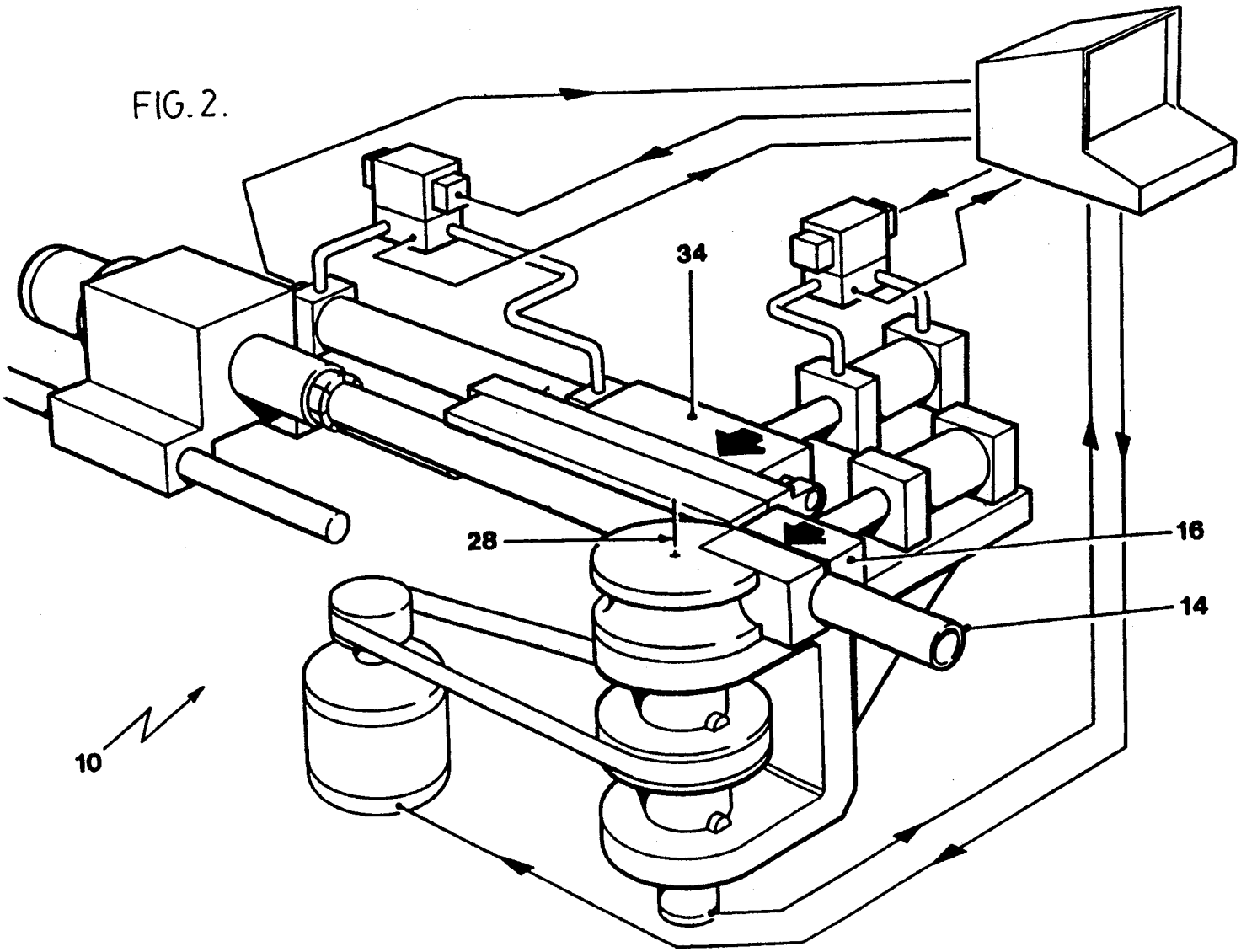
FIG. 2 is a diagrammatic, perspective view of the bending apparatus as shown in FIG. 1, wherein the tube is in a clamped, pre-bend position.
Figure 3:
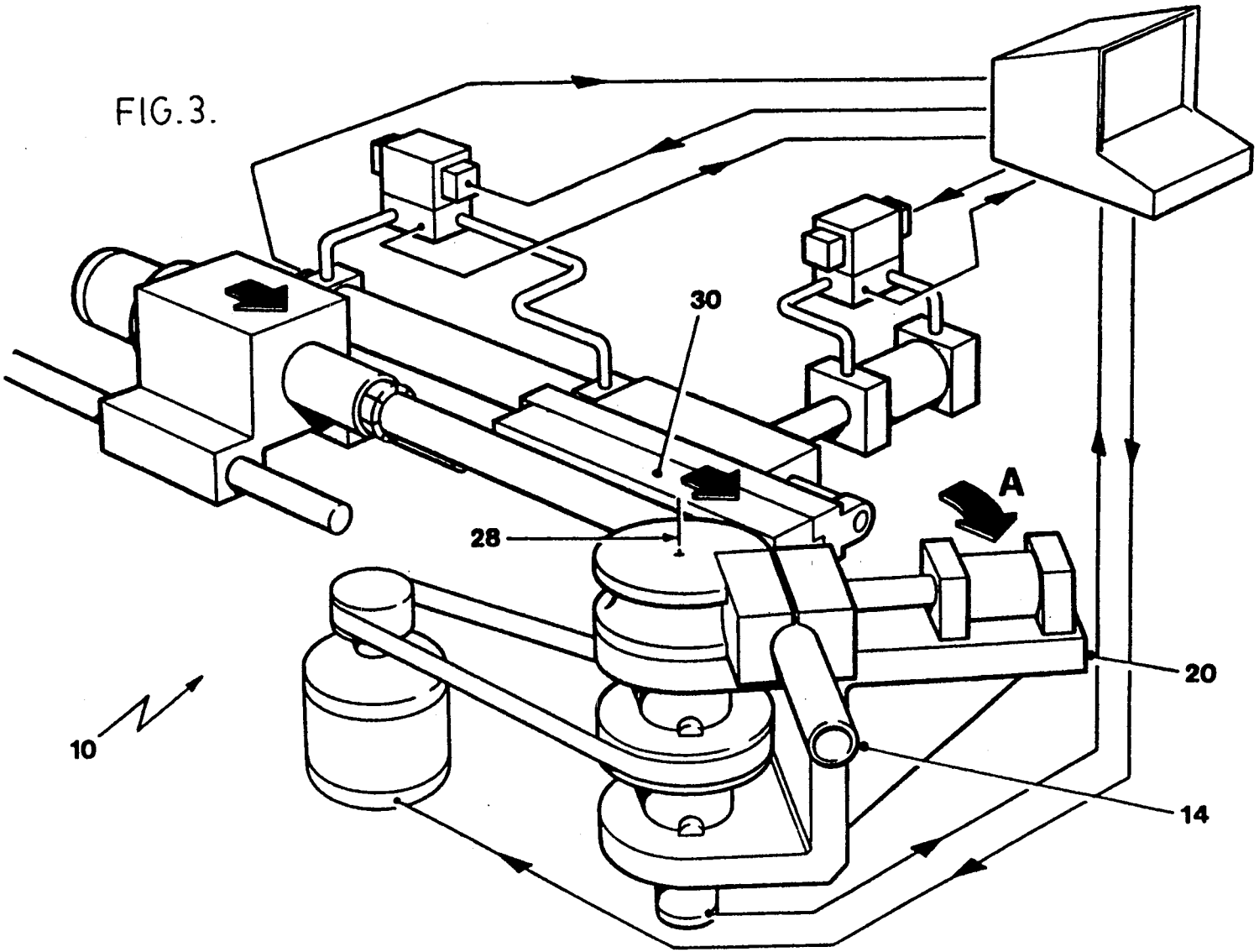
FIG. 3 is the apparatus as shown in FIG. 2 wherein the tube is in a post-bend position.
Figure 4A:
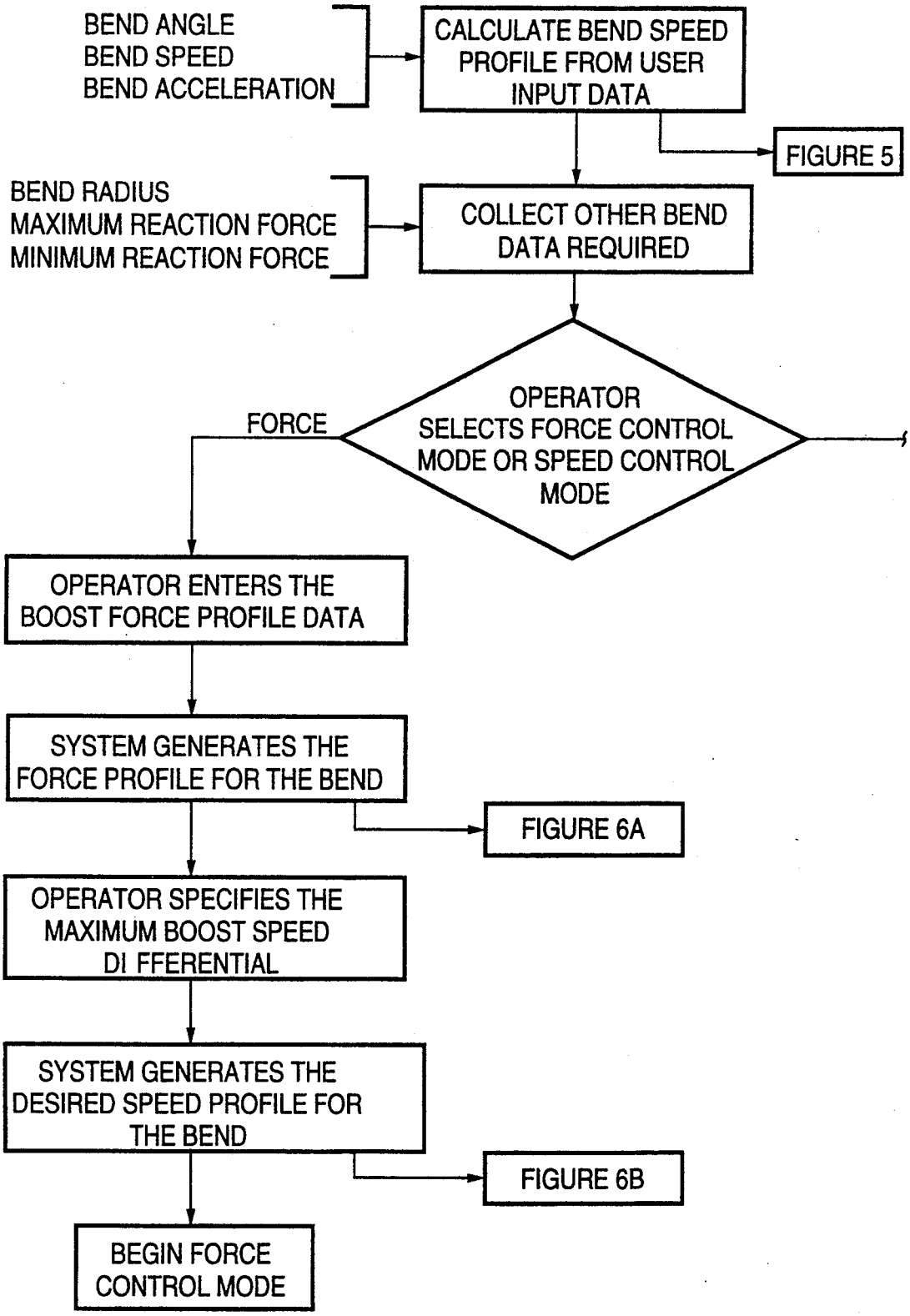
FIG. 4*a* and 4*b* is a block diagram representing the interaction of machine operator and control means flow chart for data entry.
Figure 4B:
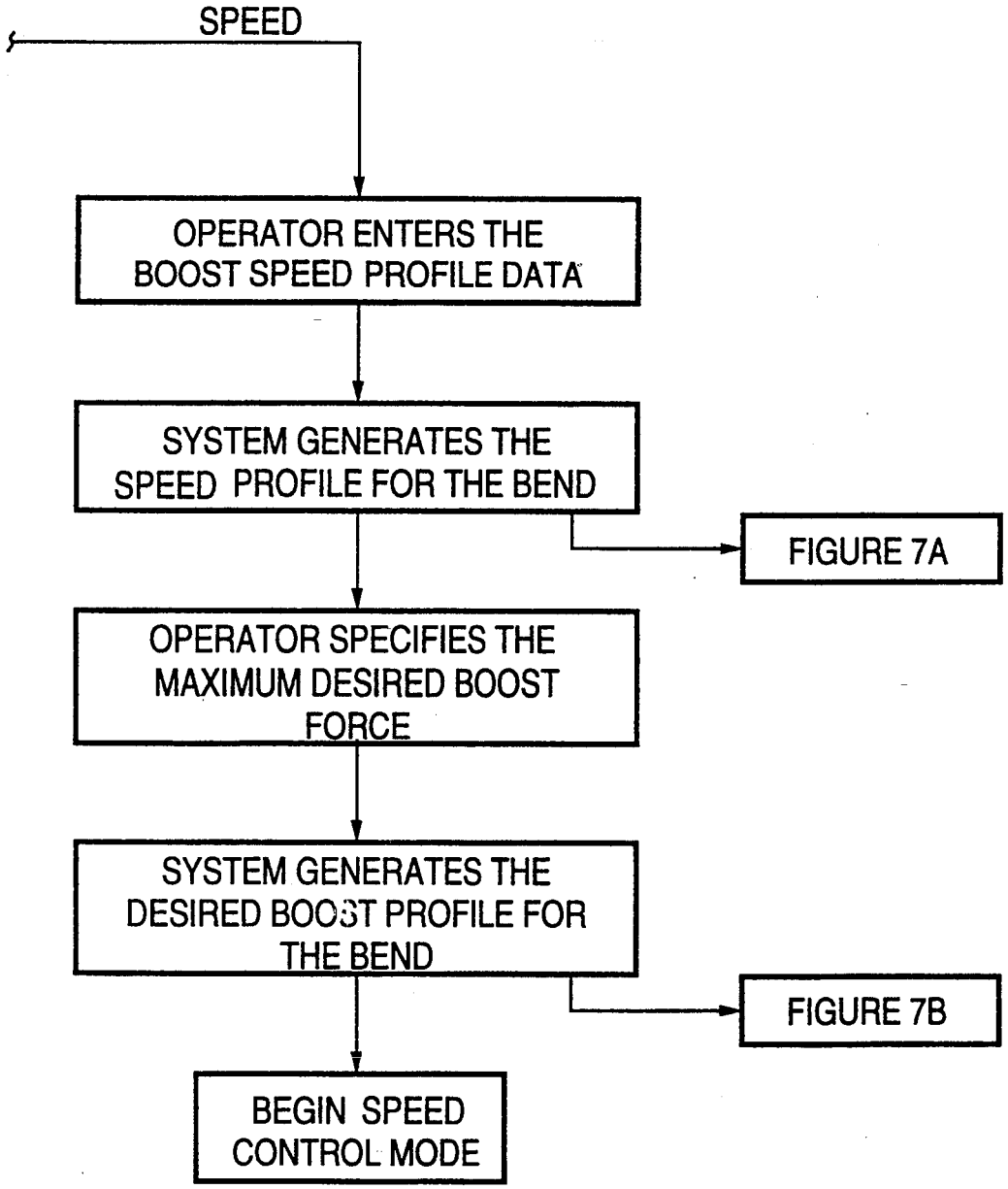

FIG. 1 shows a pipe bending machine generally as 10 having a bending form block 12 around which is formed a tube 14. Tube 14 is held against block 12 during the bending operation by a clamp block 16, which is advanced and retracted by a clamp block actuator 18 before and after each bending operation. FIGS. 1 and 2 show the pre- and post-clamping of tube 12 by clamp block 16, respectively. Bending form block 12 is mounted on a bend arm 20 of a bend arm assembly, shown generally as 22, which also houses the clamp system. Rotation of bend arm assembly 22 around the bend axis 28 shown by arrow A direction in FIG. 3, is carried out by a bend arm actuator 24 which moves under the influence of a bend arm control valve (not shown) to transmit the required bending torque to tube 12. Actuator 24 moves at a speed proportional to the speed of motion of an oil flow generated by the bend arm control valve under the control of a supplied command signal.

Assembly 22 has a bend arm encoder 26 which electronically encodes the angle of position of bend arm 20 to provide the control system with the degree of bend at all times during the bending operation of tube 14 around bend axis 28.

Tube 14 is also held against block 12 by a follower or pressure die 30, which counters the reaction force of tube 14 during bending and also boosts/restrains the forward motion of tube 14 during the bending operation. Follower die 30 cooperates with follower slide 32, housed in a reaction block 34, to allow follower die 30 to move horizontally along the longitudinal axis of and with tube 14 during the bending operation. The forward motion of tube 14 during bending may be boosted or restrained by the action of a follower die actuator 36, which moves proportionally to the speed of motion of an oil flow generated by a follower control valve 38 under the control of a supplied command signal.

Follower slide 32 has a follower slide encoder 40 which electronically encodes the position of follower slide 32 along the axis of tube 14; and a follower slide pressure transducer 42 which electronically encodes the force being applied to follower die 30 by follower die actuator 36.

Reaction block 34 is provided with a reaction block actuator 46, which moves follower die 30 towards or away from block 12 and, thus, controls the perpendicular force exerted against tube 14 by follower die 30. Tube 14 has a back end 48 held within a tube collet 50 which positions tube 14 rotationally to determine the plane of the bend. Tube collet 50 is carried on tube carriage 52 which traverses the machine base in order to position tube 14 for bending. A reaction block control value 54 provides an oil pressure, i.e. reaction force, proportional to a supplied command signal; and a reaction force pressure transducer 56 electronically encodes the reaction force being applied to tube 14 by reaction block actuator.

FIGS. 1–3 further show a digital computer control system 58 embodying software which interprets feedback from position encoders 26, 40 and force sensing device 42. Control means 58 generates command signals to maintain the programmed relationship between the position of the bend die and clamp, the position of pressure die 30 and the forces exerted on tube 14. Thus, system 56 generates command signals to actuators 18, 24, 36 and 46 to maintain the pre-programmed relationship between the position of bending form block 12, clamp block 16, the position of follower die 30 and the forces exerted on tube 14.

Alternative follower slide pressure transducers include, for example, torque transducers and electrical current monitors.

In a bending operation, tube 14 is grasped in rotatable collet 50 mounted on tube carriage 52. Carriage 52 moves along the base of machine 10 in a direction parallel to the longitudinal axis of tube 14 grasped in collect 50. Carriage 52 and collet 50 are used to position tube 14 longitudinally and rotationally in relation to bending form block 12 prior to making a bend in tube 14.

Once tube 14 has been positioned, clamp block 16 is moved forward by clamp block actuator 18 against bending form block 12 and thus clamping a section of tube 14 immediately preceding the section where the bend is to be made. Reaction block 34, which contains follower slide 32 is also advanced towards tube 14 by reaction block actuator 46 such that follower die 30 is pressed against the outer wall of tube 14.

When all of forming blocks 12, 13 and 34 are in place relative to tube 14, bend arm actuator 24 begins to rotate bend arm 20 around bending axis 28. Bending form block 12 and clamp block 16 are fixed to bending arm 20 and, thus, also rotate about bending axis 28. This action pulls tube 14 around bending form block 12 to form the bend. During the bending operation, follower die 30, which is held against tube 14 by reaction block actuator 46 resists the reaction force created in tube 14 to ensure that it remains correctly aligned with chuck 50 on tube carriage 52.

As tube 14 is pulled around bending form block 12, follower die actuator 36 is used to move follower die 30 forward with tube 14. The rate of this motion may be set such that follower die 30 moves at the same speed as tube 14 or it may have a positive or negative motion relative to tube 14.

By using follower die actuator 36 to exert a negative boost force on follower slide 32 during the bending operation, the frictional force between follower die 30 and tube 14 can be used to restrain the forward motion of tube 14 as it is pulled around rotating bend form block 12. This, thus, causes tube 14 to be drawn through the mating cavities of follower die 30 and bending form block 12. This action of restricting the flow of material into the bending area can prevent wrinkles from forming on the inner radius of the bend.

Alternatively, follower die actuator 36 can exert a forward boost force to follower slide 32 during bending such that the frictional force between follower die 30 and tube 14 is used to force the material along the outer wall of tube 14 into the bend, thereby greatly reducing the material thinning along the outer wall. Many factors in the bending operation including the type of material to be bent, the shape of the section to be bent, the wall thickness of the material and the radius of the bend to be made, will affect the degree to which the material needs to be restrained and/or boosted in order to achieve the desired results.

Figure 5:
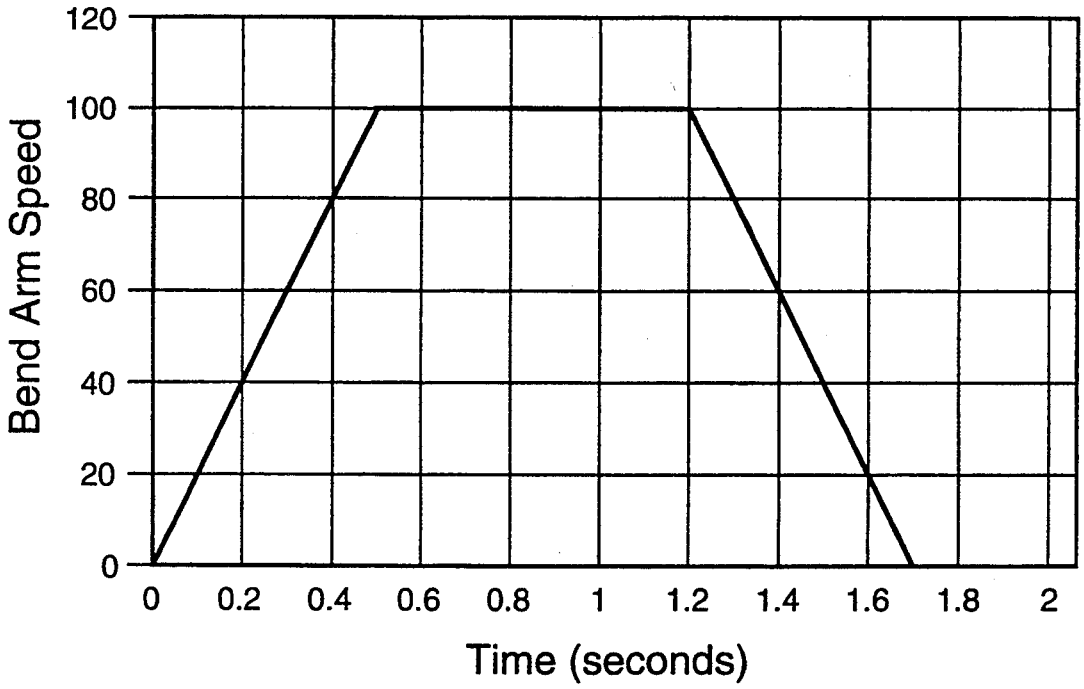
FIG. 5 represents a bend speed profile curve.

FIG. 5 shows the speed profile followed by the bend arm during the bend. During the first 1/5 second, bend arm 20 accelerates to the programmed speed of 100°/second, for example. Bend arm 20 then travels at a constant speed for 0.7 seconds before decelerating to a halt. The final position will be 120° from the starting axis. This profile is downloaded to a servo control board in control system 58 and is maintained by monitoring the position feedback from bend arm encoder 26 and adjusting the command to the bend arm control valve accordingly.

Figure 6A:
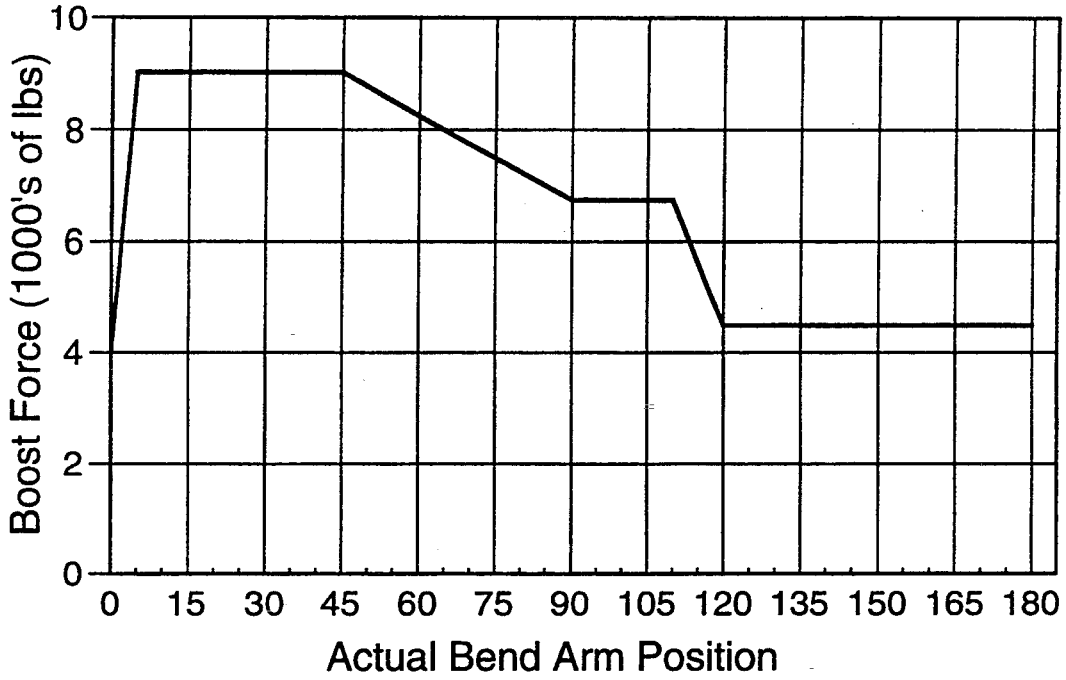
FIGS. 6*a* and 6*b* represent a typical boost force profile and associated boost speed profile, respectively, in force control mode.

FIG. 6*a* shows the boost force applied to tube 14 as a function of the actual bend arm position. This curve is defined by the user profile data. For example, the force begins at 4,500 lbs. at the start of the bend and increases to 9,000 lbs. as bend arm 20 moves to 5°, remains constant at 9,000 lbs. until bend arm 20 reaches 45°, reduces to 6,750 lbs. as bend arm 20 moves from 45° to 90° and then remains constant at 6,750 lbs. When bend arm 20 is 10° from the end of the bend, i.e. at 110° in this example, the boost force will taper off to 4,500 lbs.

Figure 6B:
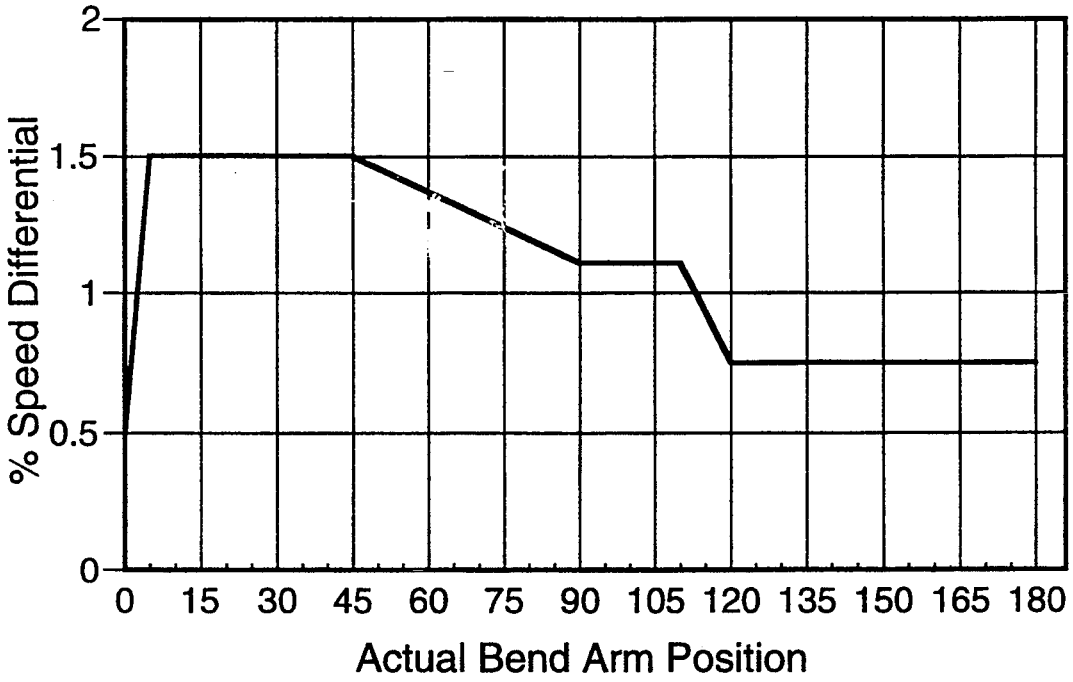

FIG. 6*b* shows the follower speed curve associated with the boost force profile from FIG. 5. This curve has the same basic shape as the force profile since the speed differential will be related to the boost force applied. The maximum speed differential is achieved when the boost force is at its highest value and the speed is proportional to the applied force during the rest of the bend.

Figure 7A:
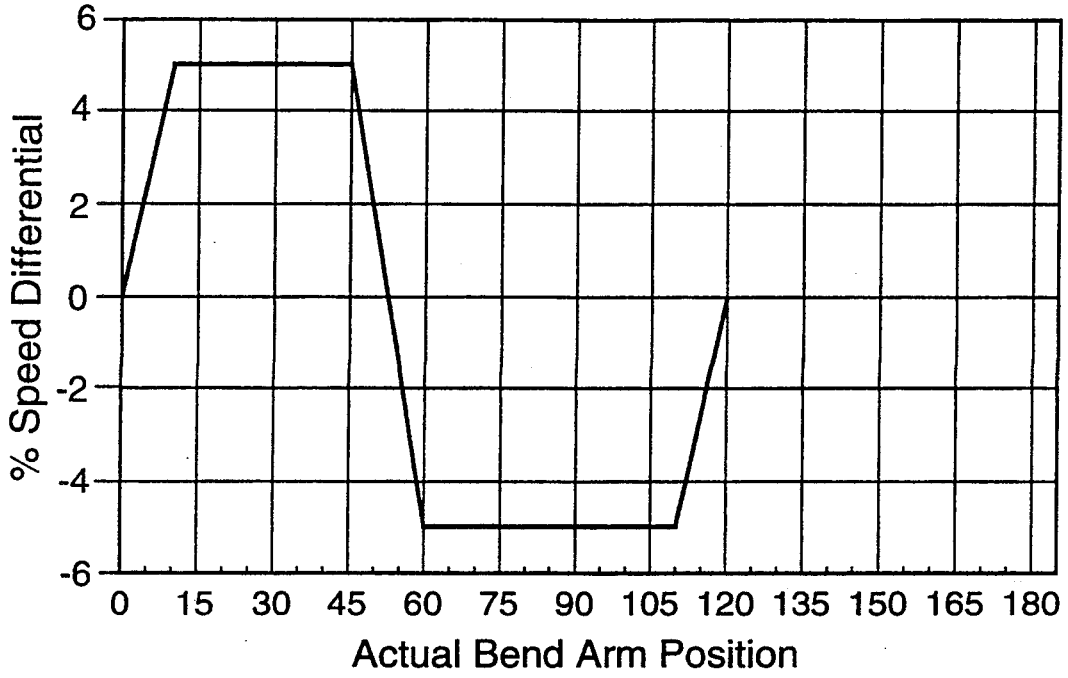
FIGS. 7*a* and 7*b* represent a typical boost speed profile curve and boost force profile curve, respectively, in speed control mode.

FIG. 7*a* shows the follower speed profile, defined as a differential between the circumferential speed of bending form block 12 and follower die 30 as a function of the actual bend arm position. This curve is defined by the user profile data. The speed differential begins at 0% at the start of the bend, increases to 5% as bend arm 20 moves to 10°, remains constant until bend arm 20 reaches 45°, reverses to a −5% differential as bend arm 20 moves from 45° to 60° and then remains constant. When bend arm 20 is 10° from the end of the bend, i.e. at 110° in this example, the speed differential will begin to taper off, reaching 0% by the end of the bend.

Figure 7B:
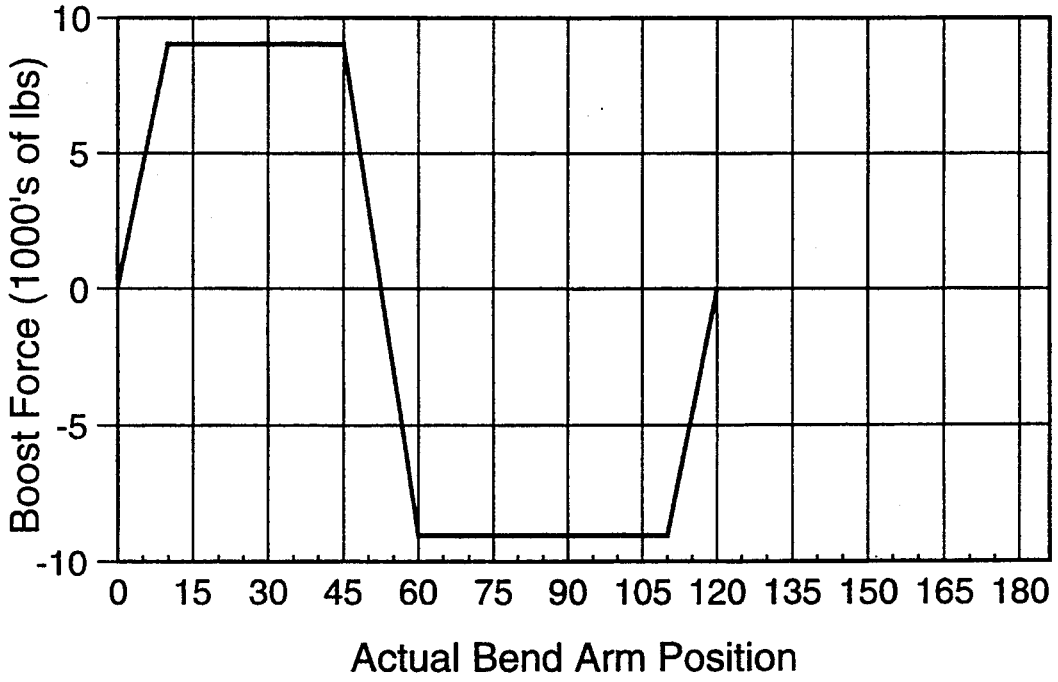

FIG. 7*b* shows the boost force profile associated with the follower speed curve from FIG. 7*a*. This curve has the same basic shape as the speed profile, since the speed differential will be related to the boost force applied. The maximum boost force is applied when the required speed differential is greatest and is reduced when lower speed differentials are required. Note that the boost force will be in the reverse direction when a negative speed differential is required.

Figure 8A:
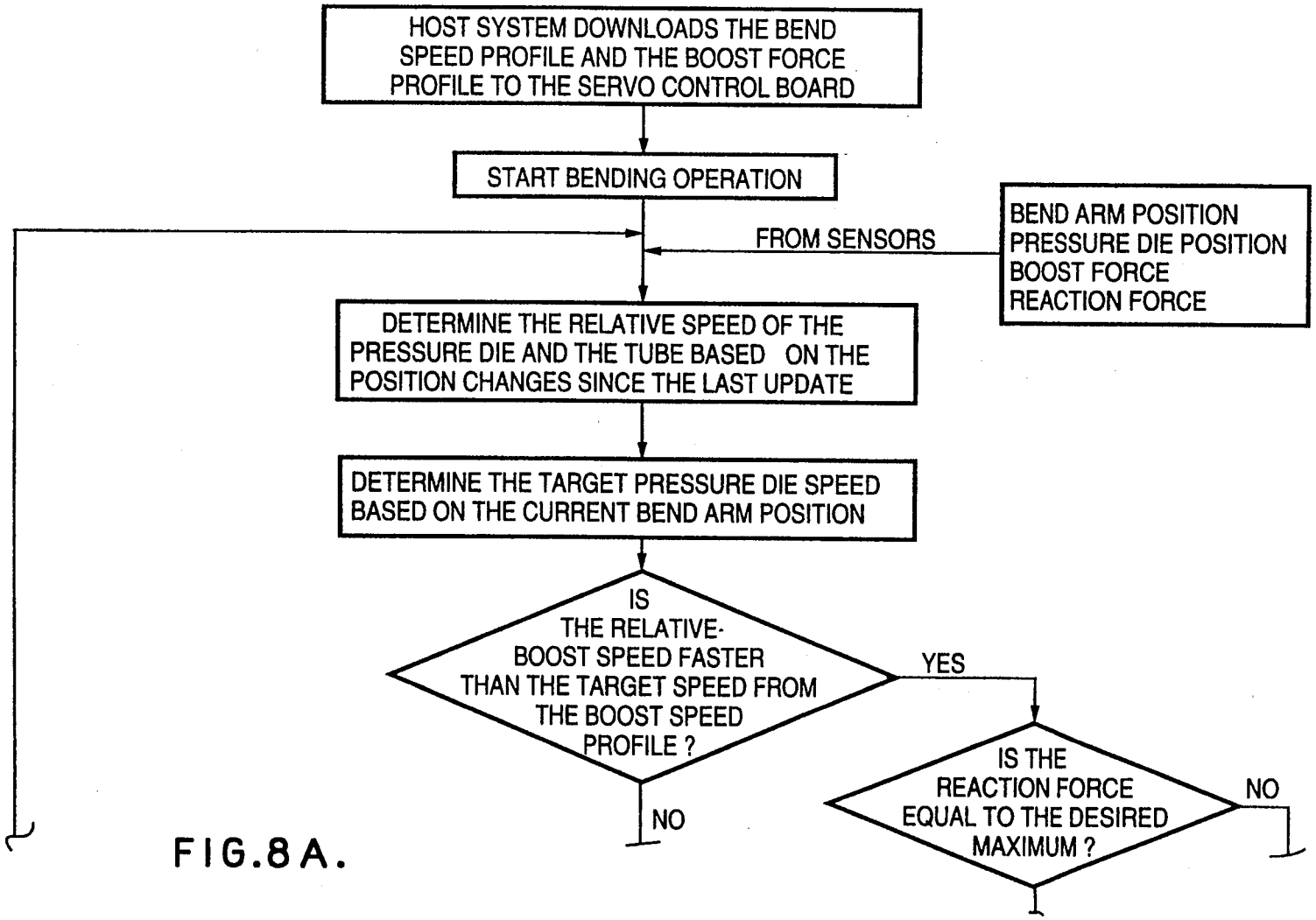
FIG. 8*a* and 8*b* represents a block diagram representing the control flow chart for operation in the force control mode.
Figure 8B:
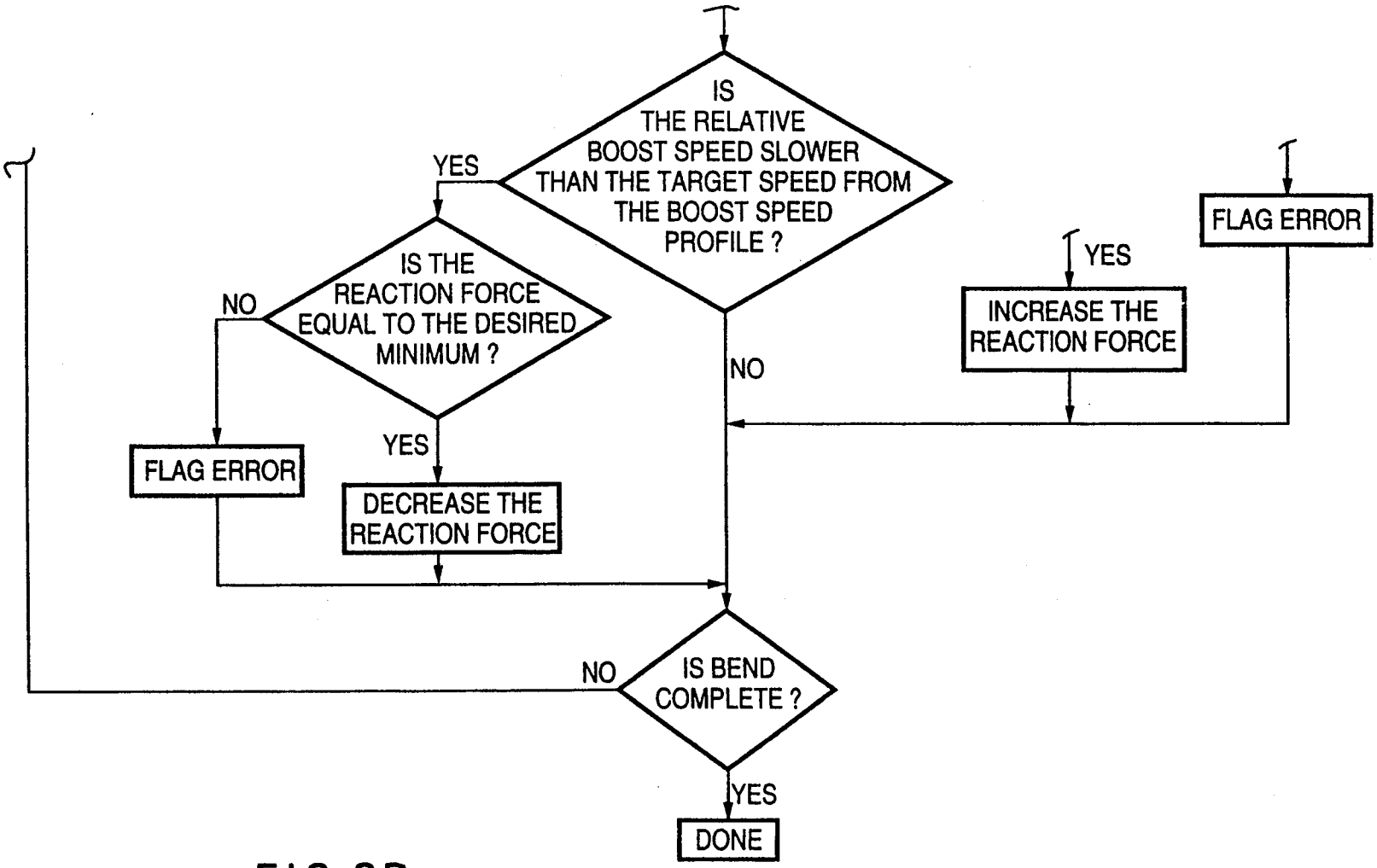

With reference to FIG. 8*a* and 8*b* , in force control mode, host computer 58 will download the desired bend speed profile and the pressure die boost force profile to the servo control board and will start the bending operation. The servo control board will adjust the command signals to bend arm actuator 24 and pressure die boost actuator 36 to maintain the programmed profiles. While the bending operation is running, host computer 58 will continuously monitor the position of pressure die 30 and bend arm 20. The position of tube 14 is calculated based on the position of bend arm 20 and the programmed radius of bending form block 12. Based on the rate of change in these positions, host computer 58 will determine the relative speed between pressure die 30 and tube 14. This is then compared to the desired speed relationship from the speed profile generated in FIG. 7. If pressure die 30 is moving too fast, the reaction force is increased such that the friction between tube 14 and pressure die 30 increases and, thus, the relative speed of pressure die 30 will be reduced. Alternatively, if pressure die 30 is moving too slowly, the reaction force is decreased such that the friction between tube 14 and pressure die 30 decreases and, thus, the relative speed of pressure die 30 will be increased. The system will only adjust the reaction force applied by reaction block actuator within the programmed limits. If the desired pressure die speed profile cannot be maintained within the programmed limits, an error will be flagged to indicate the process is no longer in control.

Figure 9A:
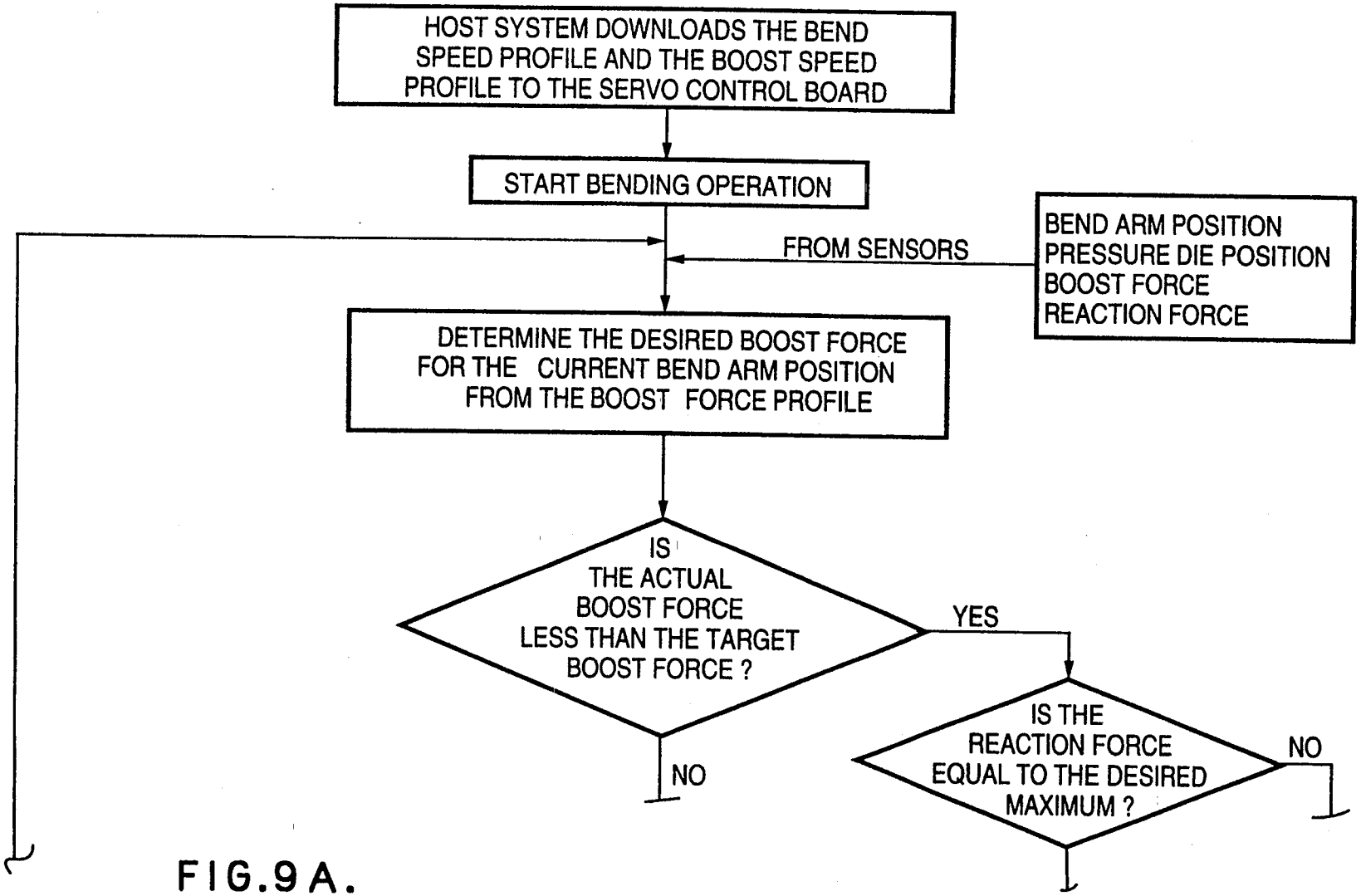
FIG. 9*a* and 9*b* represents a block diagram representing a flow chart for operation in the speed control mode.
Figure 9B:
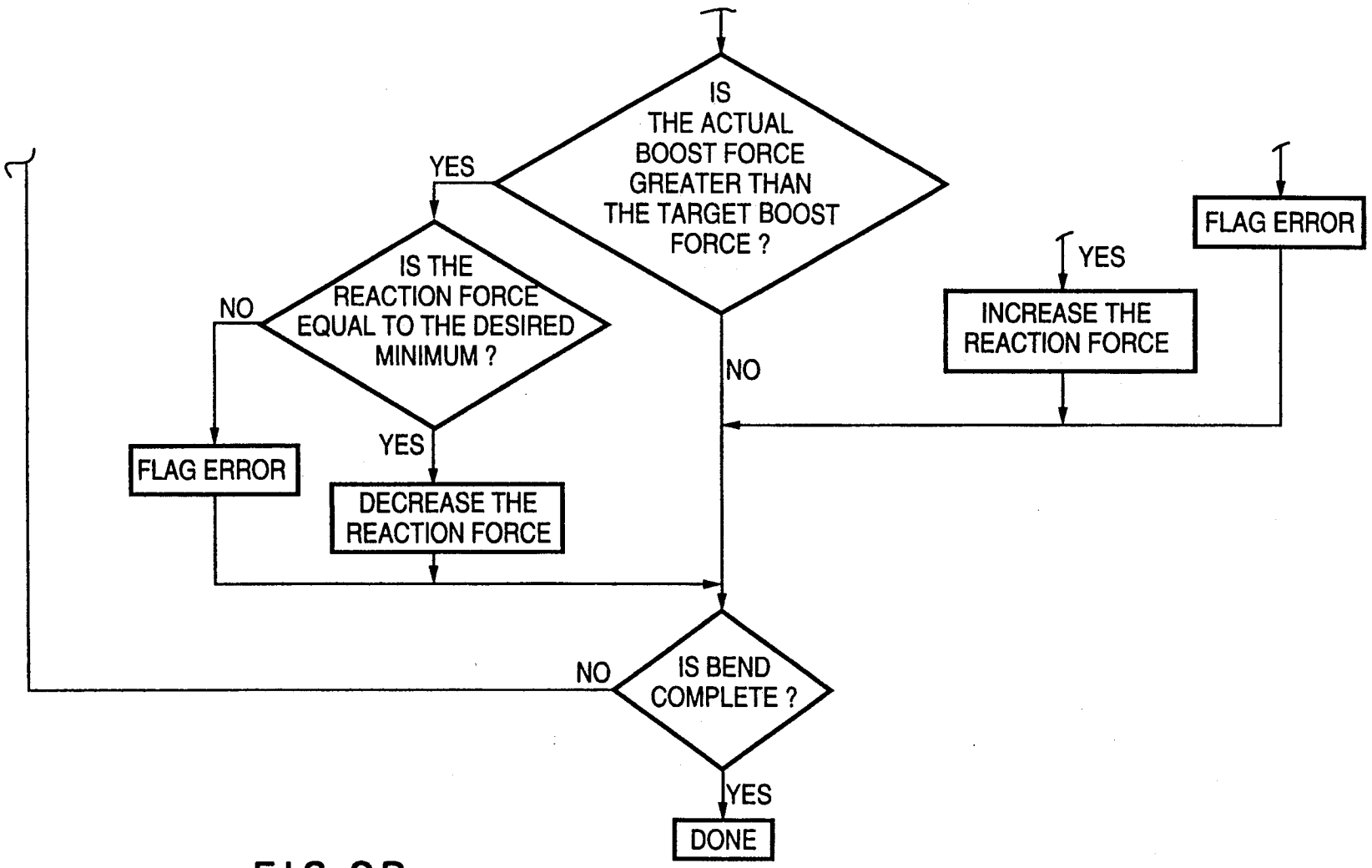

In speed control mode (FIG. 9*a* and 9*b*), host computer 58 will download the desired bend speed profile and the pressure die speed profile to the servo control board and will start the bending operation. The servo control board will adjust the command signals to bend arm actuator 24 and pressure die boost actuator 36 to maintain the programmed profiles. While the bend is forming, host computer 58 will continuously monitor the pressure die boost force and the bend arm position. The host computer will compare the actual boost force to the desired speed boost force from the boost force profile generated in FIG. 7. If the pressure die boost force is too low, the reaction force is increased such that the friction between tube 14 and pressure die 30 increases and thus the force required to maintain the programmed speed profile will increase. Alternatively, if the pressure die boost force is too high, the reaction force is decreased such that the friction between tube 14 and pressure die 30 decreases and, thus, the force required to maintain the programmed speed profile will decrease. Again, the system will only adjust the reaction force applied by reaction block actuator 46 within the programmed limits. If the pressure die boost force cannot be maintained within the programmed limits an error will be flagged to indicate the process is no longer in control.

PROGRAM DATA—FORCE CONTROL MODE

The boost force profile data is entered as series of up to 10 angular trip points which correspond to the bend arm position with an associated boost force value at each point. The control system interpolates the applied force between each of the programmed trip points to provide a smooth transition between settings. A taper function can be used to override the programmed force profile at the end of each bend. This allows the machine to achieve a smooth end to each bend regardless of the final bend angle by reducing the forces applied to the tube. The taper function is programmed as an angle, which indicates how far from the end of the bend the tapering will begin and a final value, which indicates the desired force setting at the end of the bend. The maximum speed for the pressure die boost is entered as a percentage difference between pressure die 30 and tube 14. The system calculates the tube speed based on the programmed bend speed profile and the radius of bending form block 12. The maximum speed differential programmed is then scaled to follow the boost force profile to generate the desired speed profile. The boost force curve for the sample data below is shown in FIG. 6*a* and the associated boost speed profile is shown in FIG. 6*b*.

| | | | | | |
|---|---|---|---|---|---|
| Profile Data | | | | | |
| Bend Angle (degrees) → | 0 | 5 | 45 | 90 | I80 |
| Boost Force (pounds) → | 4500 | 9000 | 9000 | 6750 | 6750 |
| Taper Data | | | | | |
| Final Bend Angle (degrees) | → | 120 | | | |
| Taper Angle (degrees) | → | 10 | | | |
| Final Boost Force (pounds) | → | 50 | | | |
| Boost Speed Data | | | | | |

-continued

| | | |
|---|---|---|
| Maximum Speed Differential | → | 5% |

PROGRAM DATA—SPEED CONTROL MODE

The boost speed profile data is entered as a series of up to 10 angular trip points with an associated speed differential entered as the percent difference between the speed of tube 14 and the speed of follower die 30. The control system 58 interpolates the speed relationship between each of the programmed trip points to provide a smooth transition between settings.

The boost speed profile data is entered as a series of up to 10 angular trip points which correspond to the bend arm position with an associated boost speed at each point. The boost speeds are entered as a percent difference between the pressure die speed and the tube speed. The control system interpolates the speed between each of the programmed trip points to provide a smooth transition between settings. A taper function can be used to override the programmed speed profile at the end of each bend. This allows the machine to achieve a smooth end to each bend regardless of the final bend angle by reducing any speed differential at the end of each bend. The taper function is programmed as an angle, which indicates how far from the end of the bend the tapering will begin and a final value, which indicates the desired speed difference at the end of the bend. The maximum boost force is entered as a limit to the amount of force which will be applied to achieve the desired speed profile. This force is then scaled to follow the boost speed profile to generate the desired boost force profile. The boost speed curve for the sample data below is shown in FIG. *7a* and the associated boost profile is shown in FIG. *7b*.

| | | | | | |
|---|---|---|---|---|---|
| Profile Data | | | | | |
| Bend Angle (degrees) → | 0 | 10 | 45 | 60 | 180 |
| Boost Speed Differential → | 0% | +5% | +5% | −5% | −5% |
| Taper Data | | | | | |
| Final Bend Angle (degrees) | → | 120 | | | |
| Taper Angle (degrees) | → | 10 | | | |
| Final Speed Differential | → | 0% | | | |
| Boost Force Data | | | | | |
| Maximum Boost Force (pounds) | → | 9000 | | | |

While the invention has been described in detail and with reference to specific embodiments thereof, it will be apparent to one skilled in the art that various changes and modifications can be made therein without departing from the spirit and scope of the invention.

I claim:

1. An improved process for rotary draw bending a tube comprising contacting said tube with a pressure die to provide frictional contact; subjecting said tube to a bending torque to bend said tube and effect movement of said tube; applying a longitudinal pressure boost to said pressure die at a speed according to a pre-programmed speed profile; applying a perpendicular reaction force to said pressure die to maintain said frictional contact; the improvement comprising providing a pre-programmed friction profile of said tube and said pressure die interaction; measuring any change in the speed of said pressure die relative to said tube; causing said boost pressure acting on said pressure die to following a pre-selected boost profile; and automatically changing said reaction force in response to said change in said relative speed of said pressure die to maintain said friction profile.

2. An improved tube rotary draw bending apparatus for bending a tube comprising a bend die around which a bend in said tube is formed and a pressure die to counter the reaction force of said tube during the bending operation, the improvement comprising means for maintaining a pre-programmed frictional profile of the interaction of said tube with said pressure die during the bending operation; wherein said means to maintain said frictional profile comprises speed sensing means to determine a change in the speed of said pressure die relative to said tube while the boost pressure acting on said pressure die follows a pre-selected boost profile; and reaction force change means to change the reaction force applied to said pressure die active on said tube in response to said change in said speed to maintain said friction profile; and automatic control means in communication with said speed sensing means and said reaction force change means.

3. Apparatus as claimed in claim 2 wherein said speed sensing means comprises position sensor means for determining the change of longitudinal position of said pressure die relative to said tube and in communication with said automatic control means.

4. Apparatus as claimed in claim 3 wherein said position sensor means comprises a pressure die position sensor for determining the position of said pressure die, and a bend arm position sensor for determining the position of said tube in communication with said pressure die position sensor, wherein said pressure die position sensor and said bend arm position sensor are in communication with said automatic control means.

5. Apparatus as claimed in claim 2 wherein said boost force sensing means comprises a force transducer positioned to detect the boost force applied to the pressure die during the bending operation.

6. An improved tube rotary draw bending apparatus for bending a tube comprising a bend die around which a bend in said tube is formed and a pressure die to counter the reaction force of said tube during the bending operation, the improvement comprising means for maintaining a pre-programmed frictional profile of the interaction of said tube with said pressure die during the bending operation; wherein said means to maintain said friction profile comprises boost force sensing means to determine a change in the boost force applied to said pressure die while the speed of said pressure die follows a pre-selected speed profile; reaction force change means to change said reaction force applied to said pressure die active on said tube in response to said change in said boost force to maintain said friction profile; and automatic control means in communication with said boost force sensing means and said reaction force change means.

7. An improved rotary draw bending apparatus comprising:

(a) a bending form block around which a bend in said tube is formed;

(b) a pressure die in frictional contact with said tube to counter the reaction force of the tube during the bending operation;

(c) means to provide a boost pressure to said pressure die;

(d) means to provide a reaction force to said pressure die;

(e) a rotatable bend arm assembly in communication with said bending form block and which transmits bending torque to said tube and effects relative movement of said tube and said pressure die under a pre-programmed profile;

said improvement comprising automatic sensing and control means for maintaining said pre-programmed frictional profile of the interaction of said tube with said pressure die during the bending operation; wherein said means to maintain said frictional profile comprises speed sensing means to determine a change in the speed of said pressure die relative to said tube while the boost pressure acting on said pressure die follows a pre-selected boost profile; and reaction force change means to change the reaction force applied to said pressure die active on said tube in response to said change in said speed to maintain said friction profile; and automatic control means in communication with said speed sensing means and said reaction force change means.

8. An improved rotary draw bending apparatus comprising:

(a) a bending form block around which a bend in said tube is formed;

(b) a pressure die in frictional contact with said tube to counter the reaction force of the tube during the bending operation;

(c) means to provide a boost pressure to said pressure die;

(d) means to provide a reaction force to said pressure die;

(e) a rotatable bend arm assembly in communication with said bending form block and which transmits bending torque to said tube and effects relative movement of said tube and said pressure die under a pre-programmed profile;

said improvement comprising automatic sensing and control means for maintaining said pre-programmed frictional profile of the interaction of said tube with said pressure die during the bending operation; wherein said means to maintain said friction profile comprises boost force sensing means to determine a change in the boost force applied to said pressure die while the speed of said pressure die follows a pre-selected speed profile; reaction force change means to change said reaction force applied to said pressure die active on said tube in response to said change in said boost force to maintain said friction profile; and automatic control means in communication with said boost force sensing means and said reaction force change means.

* * * * *